US010244851B1

(12) United States Patent
Petersson et al.

(10) Patent No.: US 10,244,851 B1
(45) Date of Patent: Apr. 2, 2019

(54) BAG CARRIER

(71) Applicant: Combigrip, LLC, Miami Beach, FL (US)

(72) Inventors: Ronnie Petersson, Miami Beach, FL (US); Andrzej Dzienski, Miami Beach, FL (US)

( * ) Notice: Subject to any disclaimer, the term of this patent is extended or adjusted under 35 U.S.C. 154(b) by 0 days.

(21) Appl. No.: 16/000,433

(22) Filed: Jun. 5, 2018

(51) Int. Cl.
*A45F 3/14* (2006.01)
*A45F 5/10* (2006.01)
*A45F 3/02* (2006.01)

(52) U.S. Cl.
CPC ..... *A45F 3/14* (2013.01); *A45F 3/02* (2013.01); *A45F 5/1026* (2013.01); *A45F 2003/142* (2013.01); *A45F 2003/148* (2013.01); *Y10S 224/925* (2013.01)

(58) Field of Classification Search
CPC ..... A45F 5/1026; A45F 2003/142; Y10S 224/925
USPC ..... 224/925, 607, 616, 617, 257, 258; 294/159
See application file for complete search history.

(56) References Cited

U.S. PATENT DOCUMENTS 5,361,956 A * 11/1994 Recanati ..... A45F 3/14 224/257
D362,622 S * 9/1995 Van Davelaar ..... 294/137
5,487,581 A * 1/1996 Carmo ..... A45F 5/1026 294/137
D400,785 S * 11/1998 Randall ..... D9/434
6,247,739 B1 * 6/2001 Lyon ..... A45F 5/1026 294/137
D455,348 S * 4/2002 Fludd ..... 294/137
D457,725 S * 5/2002 Parsons ..... D3/327
6,499,781 B1 * 12/2002 Flynn ..... A45F 3/10 294/159
D508,323 S * 8/2005 Douglas ..... D3/328
6,923,356 B2 * 8/2005 Reynolds ..... A45F 3/14 224/254
7,328,925 B1 * 2/2008 Jenkins ..... A45F 5/1026 294/137
D567,649 S * 4/2008 Borkowski ..... D9/434
D593,411 S * 6/2009 Bizzell ..... D9/434
D595,130 S * 6/2009 Bizzell ..... D9/434
D598,732 S * 8/2009 Bizzell ..... D8/356
10,081,306 B2 * 9/2018 Zaccaria ..... B60R 7/10
2004/0084490 A1 * 5/2004 Caputi ..... A45C 13/30 224/257
2007/0278807 A1 * 12/2007 Jenkins ..... A45F 5/1026 294/159
2009/0188955 A1 * 7/2009 Bizzell ..... A45F 3/14 224/258
2011/0000942 A1 * 1/2011 Slockbower ..... A45F 5/1046 224/251
2014/0367427 A1 * 12/2014 Bjelde ..... F41C 33/007 224/257

(Continued)

*Primary Examiner* — Justin Larson
(74) *Attorney, Agent, or Firm* — Christopher J. VanDam, PA; Chris Vandam

(57) ABSTRACT

A bag carrier having an adjustable shoulder strap affixed to a ring positioned at about the user's hips. The carrier has a clip that removably attaches to the ring. The carrier has one or more hooks to support the handles of a shopping bag. The hooks may have protrusions to hold the shopping bags better on the hooks. One or more surfaces of the carrier may have recesses to lighten the bag carrier.

4 Claims, 7 Drawing Sheets

(56) References Cited

U.S. PATENT DOCUMENTS

2015/0048638 A1* 2/2015 Manasharov ..... A45F 5/1026
294/158

* cited by examiner

BAG CARRIER

BACKGROUND OF THE INVENTION

1. Field of the Invention

The present invention relates to bag carriers, and more particularly, to an improved machine for carrying shopping bags with handles.

2. Description of the Related Art

Several designs for bag carriers have been designed in the past. None of them, however, includes a strap having an integrated ring that a hook on a carrier connects to where the ring further has hooks to hold the handles of a typical shopping bag, supporting the bag hands free and allows easy connecting and separating the hook on the carrier from the ring on the strap.

Applicant believes that the closest reference corresponds to commercially available shoulder straps with hooks. However, it differs from the present invention because the carrier 12 can be removed from the ring 22 while the bag 18 remains attached to the carrier 12. This feature becomes more important when the user is carrying several bags together because the user only needs to attach the bags to the carrier 12 once through the several modes shown in FIGS. 1 through 3.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a bag carrier that can carry multiple bags.

It is another object of this invention to provide a bag carrier that can easily transition between a hand carried mode, as demonstrated in FIG. 2, to a hands-free mode, as demonstrated in FIG. 1.

It is still another object of the present invention to provide a bag carrier having a strap that need not be removed when not actively carrying a bag.

It is another object of the present invention to keep the handles of several shopping bags collected together while attached to the strap and also when removed from the strap.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
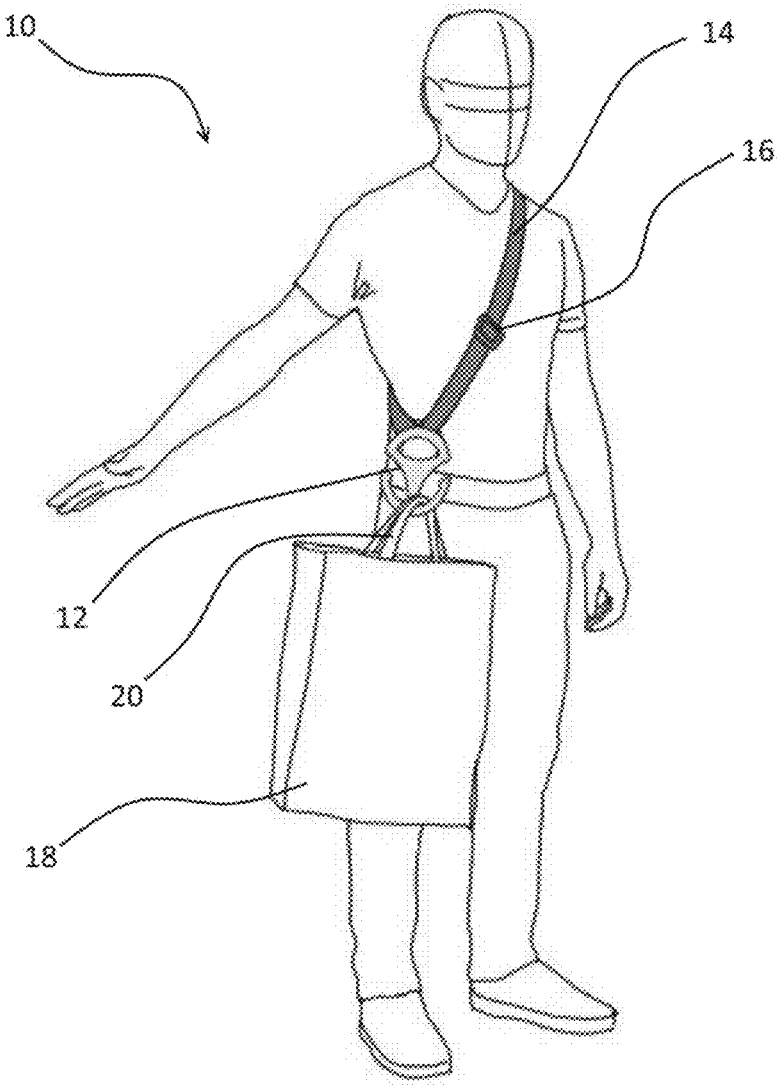
FIG. 1 shows a perspective view of a user wearing a bag carrier and carrying a bag in a hands-free mode.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the bag carrier, the carrier, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a carrier 12, a strap 14, a buckle 16, a bag 18, a handle 20, a ring 22, a loop 24, a loop 26, a handle 28, protrusions 30, hooks 32, a frame 34, a hook 36 and recesses 38.

Figure 2:
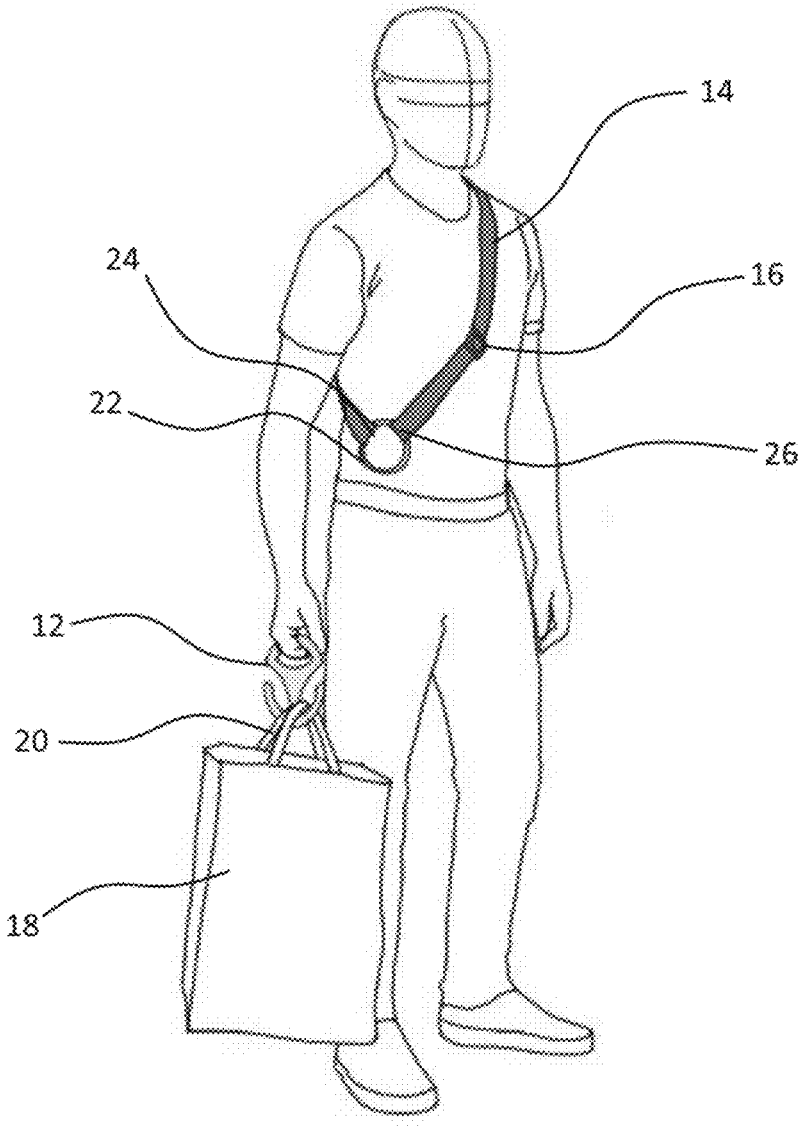
FIG. 2 shows a perspective view of a user carrying a bag by hand.
Figure 3:
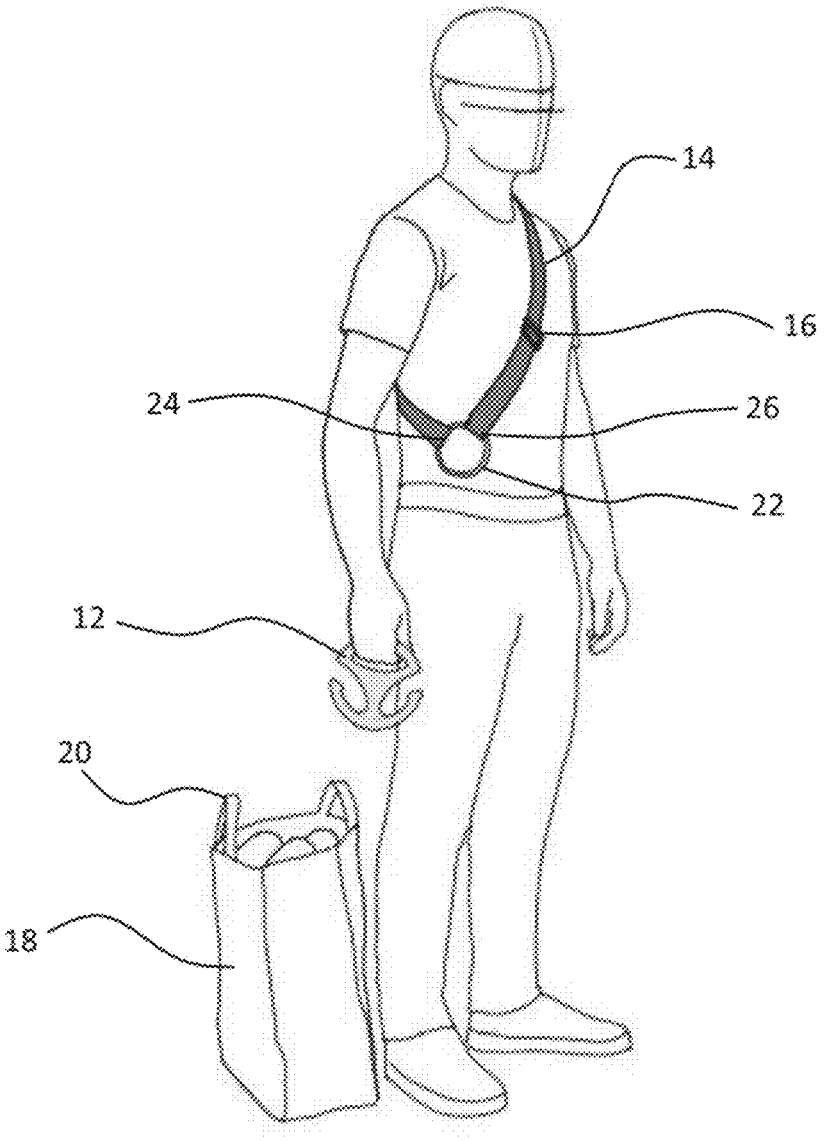
FIG. 3 shows a perspective view of a user holding a carrier separated from the belt.

FIGS. 1 through 3 show the several modes in which the bag carrier may be commonly used. In FIG. 1, the user has placed the strap 12 over their shoulder and has attached the carrier 12 to both the strap 14 and the handle 20 of the bag 18.

The carrier 12 is positioned at about the waistline of the user, but may be adjusted to user preference by manipulating the buckle 16 on the strap 14. Users of different heights can readily adjust the length of the strap 14 so that the carrier is positioned at a desired position.

The ring 22 is connected to each end of the strap 14 at loop 24 on one end and loop 26 on the other end. The buckle is between the loop 24 and loop 26. The loops 24 and 26 may be sewn or otherwise bonded back upon itself to connect to the ring 22. Other means to affix the ends of the strap 14 may also be available. Any connection of the ends of the strap 14 to the ring should be sufficiently robust to hold the weight of any anticipated contents of the bag 18.

FIG. 1 shows the hands-free mode where the entire weight of the bag carrier and the bag 18 with its contents is supported by the shoulder of the user. I this mode the user is free to use their hands for other purposes yet keeps the bag 18 securely at their side. The shoulder is better suited to support the weight of the bag 18 over longer distances than the hands of many users could maintain.

A typical use of the bag carrier may be to carry groceries home from the market. Often several bags are used and can get heavy, particularly for a long walk home. The narrow handles 20 can be uncomfortable to the hands of the user. By transferring this stress to the carrier 12 and distributing the weight across the width of the strap 14 on the user's shoulder it becomes much easier to carry bags 18 of groceries over longer distances.

FIG. 2 shows the user holding the carrier 12 in his hand. The weight of the bag 18 is more easily carried on the ergonomically designed handle 28 of the carrier 12 instead of the much narrower handle 20 on the bag 18.

When the carrier 12 is removed from the ring 22 several bags 18 may remain on the carrier 12. This can be useful when, for example, the user desires to sit or enter a vehicle. When setting the bags 18 down on the ground the handles 20 may remain together on the carrier 12 helping keep the contents from escaping the bag 18.

Similarly, when placing shopping bags 18 in the car they will tend to not shift and release the contents as the car moves. Note also that the strap 14 and ring 22 combination are low profile and need not be removed when sitting. When the user desires to stand again he can simply reattach the carrier 12, already carrying the bags 28, onto the ring 12 with minimal difficulty.

FIG. 3 demonstrates that generally the strap 14 is donned prior to attaching the carrier to the ring 22. The bag 18 is then hooked onto the carrier. The carrier 12 and bag 18 combination is then attached to the ring 22 when the device can be use hands-free. The reverse order of these operations is used to separate the user from the device when he is done using it.

Figure 4:
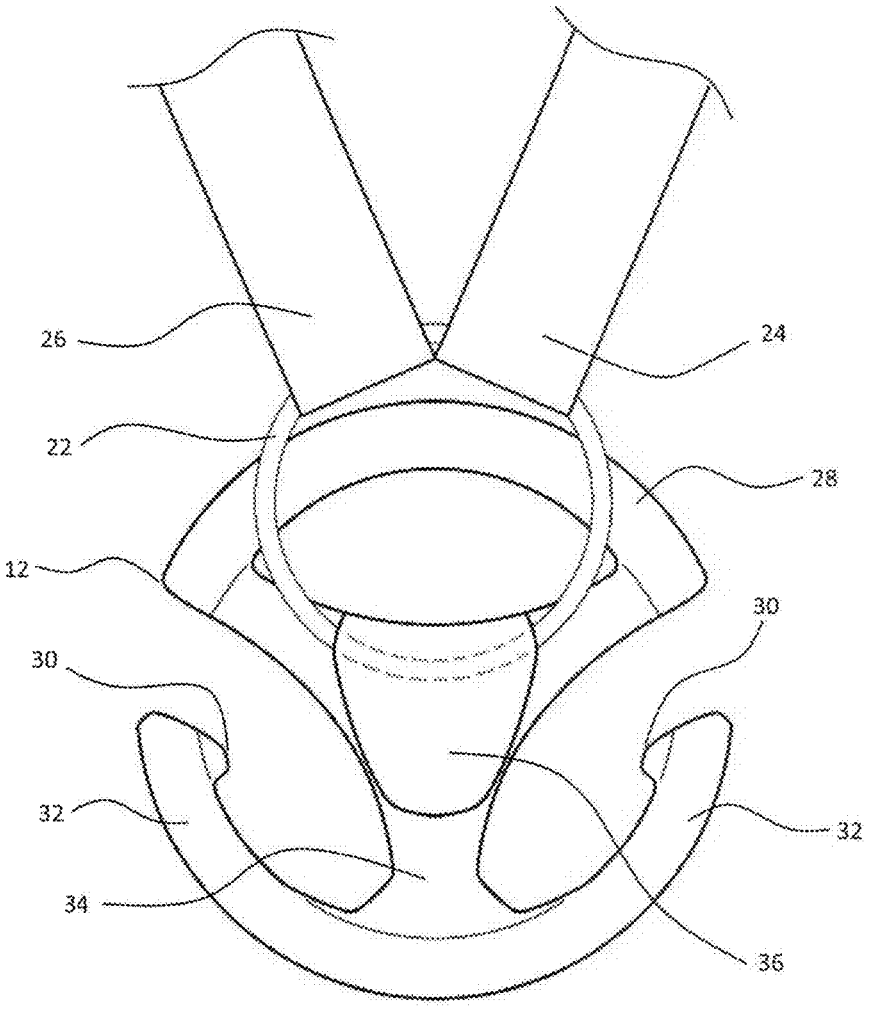
FIG. 4 shows an elevation view of a reverse side of a bag carrier.
Figure 5:
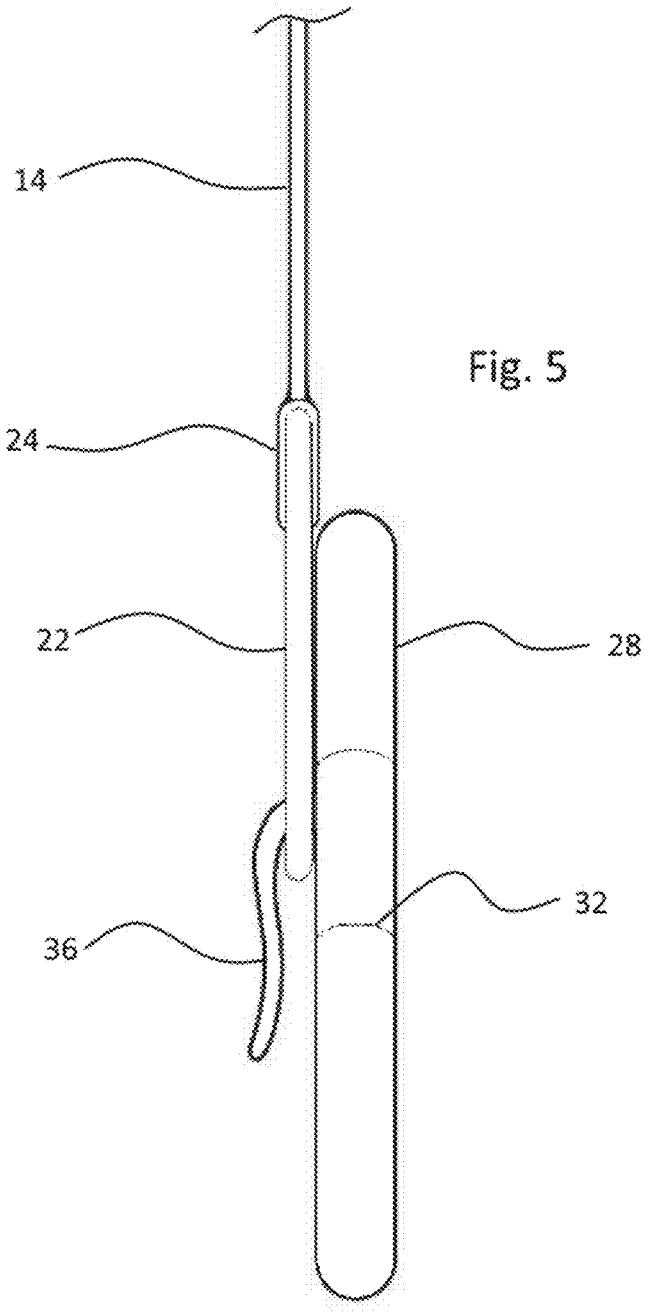
FIG. 5 shows an elevation view of a side of a bag carrier hooked onto a ring.

FIGS. 4 and 5 show a detailed view of the carrier 12 and part of the strap 14. The carrier 12 has a hook 36 on the back side that is dimensioned and adapted to fit over the ring 22 and carry the weight of the bag carrier along with the contents of any bags being carried. The hook 36 may frictionally fit onto the ring 22 to further secure the carrier 12 to the ring 22 and connected strap 14.

The handles 20 of the bags 18 are placed over and supported by the hooks 32. The hooks 32 are dimensioned and adapted to hold at least several bags 18. If a bag 18 has two paired handles 20, as many bags do, both handles 20 may be placed over one or both hooks 32. Because of the orientation of the hooks 32 gravity tends to keep the bags 18 well nested into the hooks 32.

Protrusions 30 may be provided on the upper tips of the hooks 32 to further ensure that the handles 20 of the bags 18 remain seated in the hooks 32. The feature of the protrusions 30 may become more significant when the carrier 12 is removed from the ring 22, such as when the user is preparing to sit.

Figure 6:
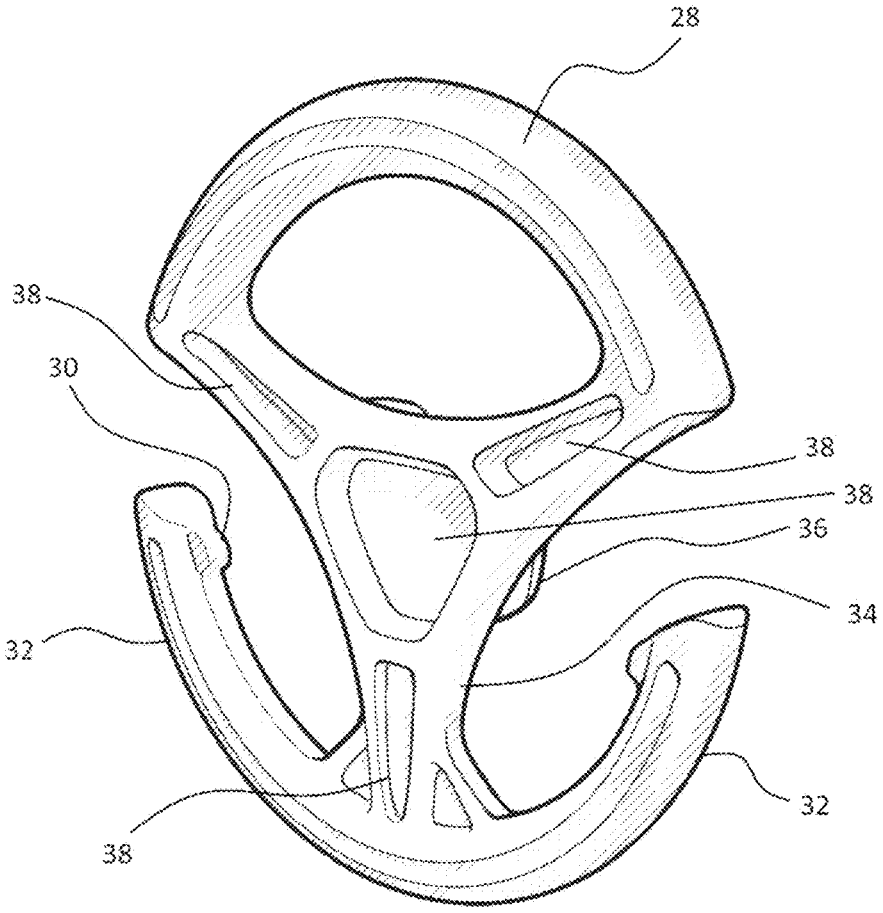
FIG. 6 shows a perspective view of an obverse side of a bag carrier.
Figure 7:
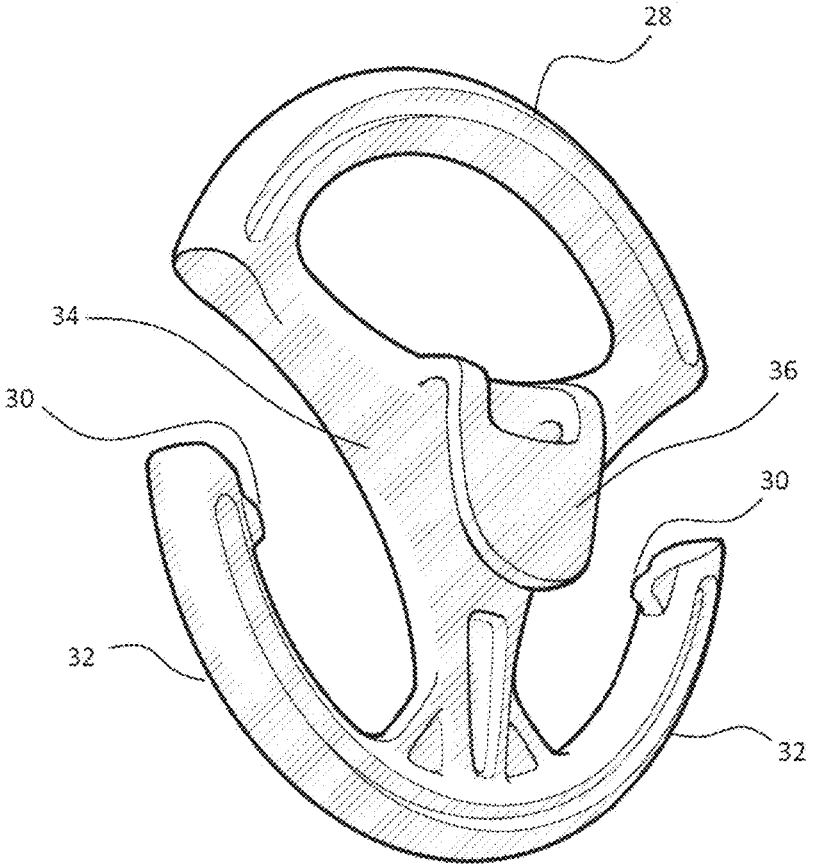
FIG. 7 shows a perspective view of a reverse side of a bag carrier.

FIGS. 6 and 7 show the carrier 12 without the other elements of the device. The handle 28 is adapted for grasping by the human hand. The handle 28 is connected to the hooks 32 by the frame 34. Recesses 38 may be provided to lighten the bag carrier and to use less material in its manufacture. The recesses 38 may also be considered decorative in nature by providing relief to the profile.

In one version of the bag carrier the carrier 12 is fabricated of a solid and rigid material such as a plastic or a metal alloy. Combinations of materials may also be used to achieved the best balance of strength, weight and cost to manufacture. The ring 22 is generally made of metal but other materials could also be utilized. For example, the ring 22 could be flexible if made from cord.

The strap 14 should be made of a durable and flexible material such as a woven webbing. Examples could include nylon, polyester, or other materials or blends. The width of the strap 14 should be sufficient to provide comfort to the user while carrying a load on their shoulders for periods of time.

At least one version of the invention can be fairly described as a bag carrier comprised of a carrier and a strap. The strap at a first end and a second end is affixed to a ring by a loop or other means. The strap is bisected somewhere along the length of the belt by a buckle that adjusts a length of the strap. The length of the strap sufficient so that when the strap is placed over a shoulder of a user the ring lies adjacent to the user's hip or waist. The length of the strap can be adjusted to customize the size of the strap for different sized users and differing preferences for placement of the ring. The carrier has a frame. The frame has on a lower side a bag hook to accept the handle of a bag, such as a shopping bag. The frame has on an upper side a handle dimensioned to be grasped by a human hand. The frame has on a first side a support hook. The support hook connects to the ring to support the carrier and bags onto the strap and the users shoulder. A handle on a shopping bag, or other bag, attaches to the bag hook or hooks. The bag carrier can further include that an upper end of the bag hook has a protrusion to help keep the shopping bags on the bag hooks. The bag carrier may also include one or more recesses on either side of the carrier to be decorative, to lighten its weight and to use less material in its manufacture.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A bag carrier comprised of a carrier and a strap;
the strap at a first end and a second end is affixed to a ring;
the strap is bisected by a buckle that adjusts a length of the strap;
the length of the strap sufficient so that when the strap is placed over a shoulder of a user the ring lies adjacent to the user's hip;
the carrier has a frame;
the frame has on a lower side a bag hook;
the frame has on an upper side a handle;
the frame has on a first side a support hook;
the support hook connects to the ring;
a handle on a shopping bag attaches to the bag hook.

2. The bag carrier in claim 1 further characterized in that an upper end of the bag hook has a protrusion.

3. The bag carrier in claim 1 further characterized in that the frame on a second side has a recess.

4. The bag carrier in claim 2 further characterized in that the frame on a second side has a recess.

* * * * *